US009488438B1

(12) United States Patent
Di Biasio et al.

(10) Patent No.: US 9,488,438 B1
(45) Date of Patent: Nov. 8, 2016

(54) SMALL VEHICLE ENCAPSULATION FOR TORPEDO TUBE VEHICLE LAUNCH

(71) Applicants: Angelo Di Biasio, Narragansett, RI (US); Christian L Archeval-Rivera, Middletown, RI (US); Christopher A. Harding, Swansea, MA (US)

(72) Inventors: Angelo Di Biasio, Narragansett, RI (US); Christian L Archeval-Rivera, Middletown, RI (US); Christopher A. Harding, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/870,105

(22) Filed: Sep. 30, 2015

(51) Int. Cl.
*F41F 3/10* (2006.01)
*B63G 8/32* (2006.01)

(52) U.S. Cl.
CPC .. *F41F 3/10* (2013.01); *B63G 8/32* (2013.01)

(58) Field of Classification Search
CPC ..... F41F 3/10; F41F 3/07; F41F 3/08; F41F 3/00; B63G 8/32; B63G 8/001; B63G 3/02
See application file for complete search history.

(56) References Cited

U.S. PATENT DOCUMENTS 2,844,073 A * 7/1958 Re ..... F41A 19/65 102/380
3,315,565 A * 4/1967 Nash ..... F41A 19/65 89/1.807
3,342,104 A * 9/1967 Robert ..... F41F 3/065 89/1.817
3,412,640 A * 11/1968 Nash ..... F41F 3/042 89/1.806
3,456,552 A * 7/1969 Nash ..... F41F 3/065 89/1.817
3,841,197 A * 10/1974 Morrisey ..... F41F 3/065 89/1.816
3,988,961 A * 11/1976 Banta ..... F41F 3/052 89/1.807
4,586,421 A * 5/1986 Hickey ..... F41F 3/07 102/411
4,635,527 A * 1/1987 Carrier ..... F41F 3/065 89/1.8
5,058,481 A * 10/1991 Drummond ..... F41F 3/065 89/1.814
6,283,005 B1 * 9/2001 Yagla ..... F41F 3/073 89/1.816
6,834,608 B1 * 12/2004 Ansay ..... B63G 8/30 114/312
7,032,530 B1 * 4/2006 Ansay ..... B63G 8/28 114/312
7,140,289 B1 * 11/2006 Ansay ..... F41F 3/07 114/316
7,159,501 B1 * 1/2007 Ansay ..... F41F 3/07 114/316
7,337,741 B1 * 3/2008 Ansay ..... B63G 8/001 114/239
8,161,899 B1 * 4/2012 Smallin ..... F41F 3/10 102/406
8,186,260 B2 * 5/2012 Martin ..... F41F 3/073 89/1.8
8,424,439 B2 * 4/2013 Bailey ..... F41F 3/042 89/1.816
8,635,937 B2 * 1/2014 Angeloff ..... F41F 3/055 89/1.811

(Continued)

FOREIGN PATENT DOCUMENTS

DE 2462267 A1 * 3/1977 ..... F41F 3/08
EP 0701101 A1 * 3/1996 ..... F41F 3/10

*Primary Examiner* — Benjamin P Lee
(74) *Attorney, Agent, or Firm* — James M. Kasischke; Michael P. Stanley

(57) ABSTRACT

A containment canister is provided for loading a vehicle. In the canister, the vehicle is restrained by a nose cap and a ring which conforms to an aft section of the vehicle. Longitudinal leads support the vehicle and provide glide surfaces during a launch. A casing with flow ports is affixed to an aft end of the containment canister with the casing encompassing an actuator with an extendable arm and an attached plug. The plug is sized to move in alignment with each canister toward a sealing ring. When the arm is extended; the plug seats against the ring. To eject the vehicle, a signal is sent an actuator to retract the plug aft of the flow ports. As the canister is flooded by a water impulse thru the flow ports; the impulse contacts the aft end of the vehicle to expel the vehicle.

8 Claims, 5 Drawing Sheets

(56) References Cited

U.S. PATENT DOCUMENTS

| | | | | |
|---|---|---|---|---|
| 8,662,441 | B2 * | 3/2014 | Powell | B64C 39/024 244/62 |
| 9,194,661 | B1 * | 11/2015 | Perciballi | F41H 5/007 |
| 2006/0214062 | A1 * | 9/2006 | Shim | F41F 3/00 244/137.1 |
| 2009/0158990 | A1 * | 6/2009 | Owen | F41F 3/10 114/316 |
| 2010/0000463 | A1 * | 1/2010 | Root, Jr. | B63B 22/06 114/316 |
| 2012/0055323 | A1 * | 3/2012 | Bailey | F42B 15/00 89/1.816 |
| 2016/0178317 | A1 * | 6/2016 | Powell | F41F 3/07 89/1.81 |

* cited by examiner

SMALL VEHICLE ENCAPSULATION FOR TORPEDO TUBE VEHICLE LAUNCH

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

This application claims the benefit of U.S. Provisional Application No. 62/080,604, filed on Nov. 17, 2014 entitled "Small Vehicle Encapsulation (SVE) Capsule for Torpedo Tube Vehicle Launch" by the inventors Angelo DiBiasio, Christian Archeval-Rivera and Christopher Harding.

BACKGROUND OF THE INVENTION (1) Field of the Invention

The present invention relates to a payload system and specifically to a system for deployment of small diameter payloads using existing submarine torpedo tubes and other similarly-shaped tubes.

(2) Description of the Prior Art

There is an increasing need to deploy small diameter payloads (weapons or vehicles) from submarine torpedo tubes. This type of deployment would enhance submarine capability for the Navy.

There is a known encapsulated payload and launcher assembly that could be loaded into a torpedo tube and could use ship services. A capsule of the assembly is self-equipped to catapult launch a vehicle. However, the capsule does not use either an impulse or swim-out launch. Also, the assembly can accommodate only one vehicle at a time.

SUMMARY OF THE INVENTION

It is therefore a general purpose and primary object of the present invention to provide a capsule and device capable of deploying multiple small diameter payloads such as weapons, vehicles or other devices.

It is a further object of the present invention to provide a capsule and device which can be launched from existing torpedo tubes.

It order to attain the objects described above, the present invention provides a capsule and supporting device which uses a water impulse.

In the present invention, a vehicle loaded into a containment canister in which the vehicle is restrained by a nose cap, longitudinal leads and a ring which conforms to an aft section of the vehicle. The longitudinal leads separate the vehicle from an interior of the containment canister and assist in the launch of the vehicle. An actuator casing is affixed to an aft end of the containment canister.

The actuator casing encompasses a linear actuator with an extendable arm and plug. The plug is sized to move in alignment with each canister toward a sealing ring. When the actuator is in the extended position; the plug seats against the sealing ring in order to seal the containment canister.

Four containment canisters can be loaded into a module frame thru a canister forward alignment plate with the containers seated/secured on a canister foot plate. The module frame assists in positioning the containment canisters. A hollow center spine in the module allows the use of cabling, communication links, etc.

In operation, a signal is sent to one of the actuators to retract the plug to be aft of the flow ports. As the containment canister is flooded by a water impulse thru the flow ports; the impulse provides sufficient energy to expel the vehicle out of the containment canister and/or the small vehicle encapsulation capsule.

The present invention provides the benefits of modularity which include ease of design, manufacturing, and maintenance as well as the ease in loading and unloading vehicle and other items to be deployed.

BRIEF DESCRIPTION OF THE DRAWINGS

Other objects, features and advantages of the present invention will become apparent upon reference to the following description of the preferred embodiments and to the drawing, wherein.

DETAILED DESCRIPTION OF THE INVENTION

Figure 1:
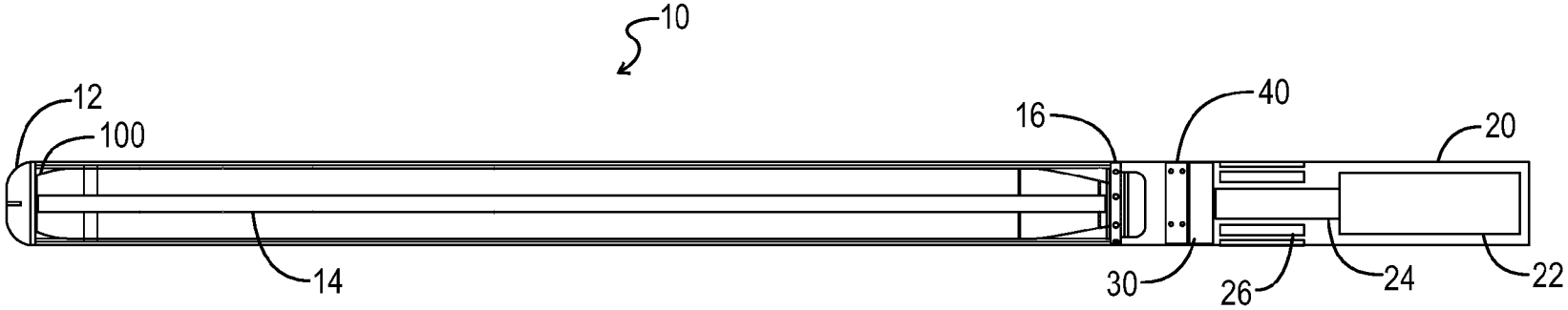
FIG. 1 depicts a cut-away view of a containment canister of the present invention with the view including stowage of a vehicle with a longitudinal rail of the containment canister shown in relation to the vehicle.

The present invention depicted in FIG. 1 allows a vehicle 100 to be loaded into a containment canister 10. The vehicle 100 is restrained by a nose cap 12, at least three longitudinal leads 14 and a retainer ring 16 which conforms to an aft section of the vehicle. The longitudinal leads 14 separate the vehicle 100 from an interior of the containment canister 10 as well as providing glide surfaces when the vehicle is launched from the canister. An actuator casing 20 is mechanically attached or affixed to an aft open end of the containment canister 10.

The actuator casing 20 encompasses a linear actuator 22 with an extendable arm 24. A plurality of flow ports 26 are positioned in a periphery of the actuator casing 20. A plug 30 is affixed to an end of the actuator arm 24. The plug 30 (acting as valve) is sized to move in alignment with each containment canister 10 toward an individual sealing ring 40. When the actuator 22 is in the extended position (as shown in the figure); the plug 30 seats against the sealing ring 40. The default configuration of each containment canister 10 maintains the plug 30 in this closed position in order to seal the containment canister.

Figure 2:
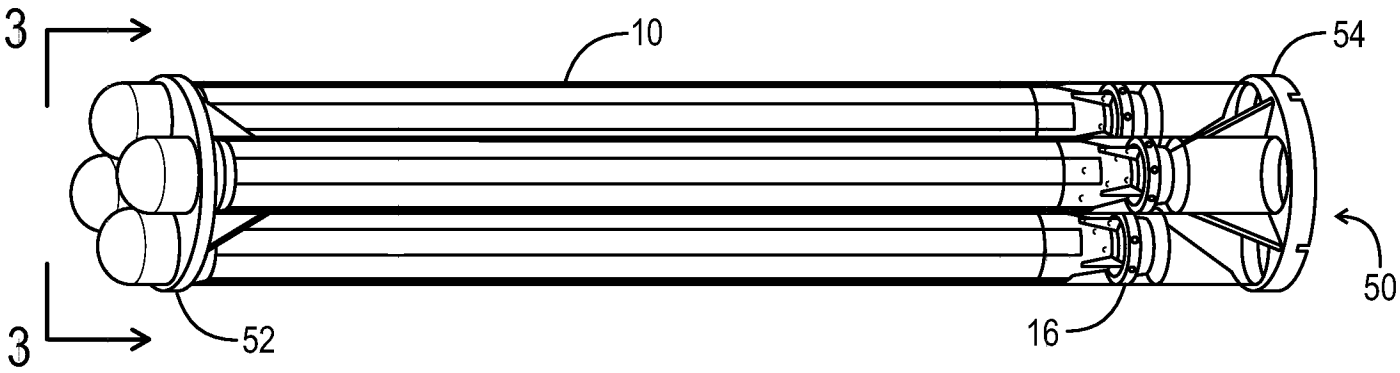
FIG. 2 depicts a perspective view of a module frame of the present invention loaded with four containment canisters.
Figure 3:
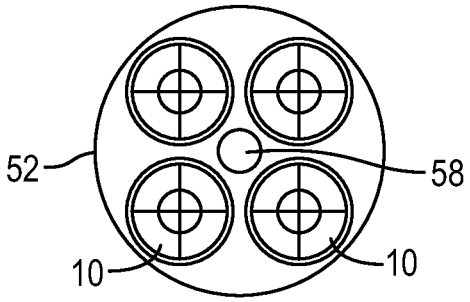
FIG. 3 depicts an end view of the module frame with the view taken from reference lines 3-3 of FIG. 2.

As shown in FIG. 2 and the end view of FIG. 3, four containment canisters 10 can be loaded into a module frame 50 as a bundle. The loading of the canisters 10 is thru a canister forward alignment plate 52 with the containers seated/secured on a canister foot plate 54.

Figure 4:
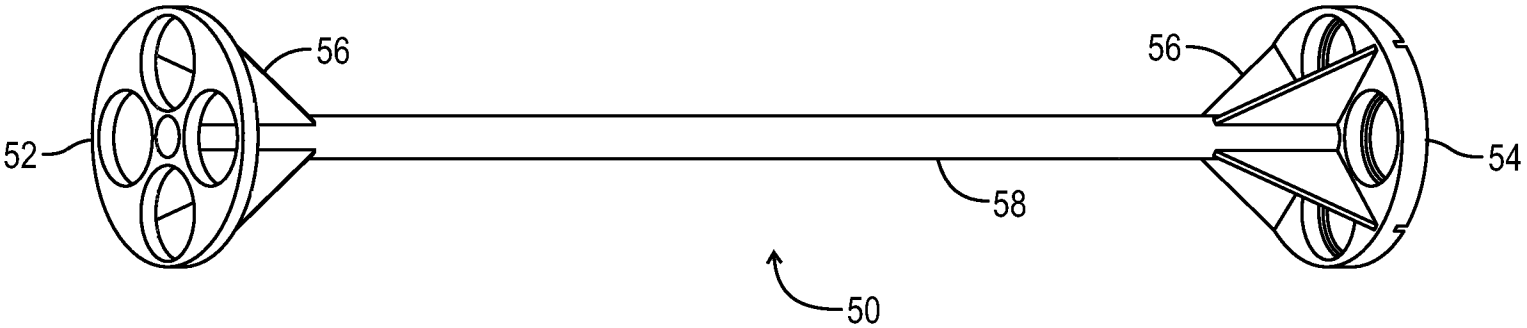
FIG. 4 depicts a perspective view of the module frame.

The detail view of FIG. 4 depicts an unloaded module frame 50. Gussets 56 at the alignment plate 52 and the foot plate 54 strengthen the structural integrity of the module frame 50 as well as assisting in the positioning of the containment canisters 10. A hollow center spine 58 allows the use of cabling, communication links, etc; however, the spine would be plugged or would use stuffing boxes for the penetrating cables. The module frame 50 is normally made from strengthened steel; however, other suitable materials known to those skilled in the art may be used.

Figure 5:
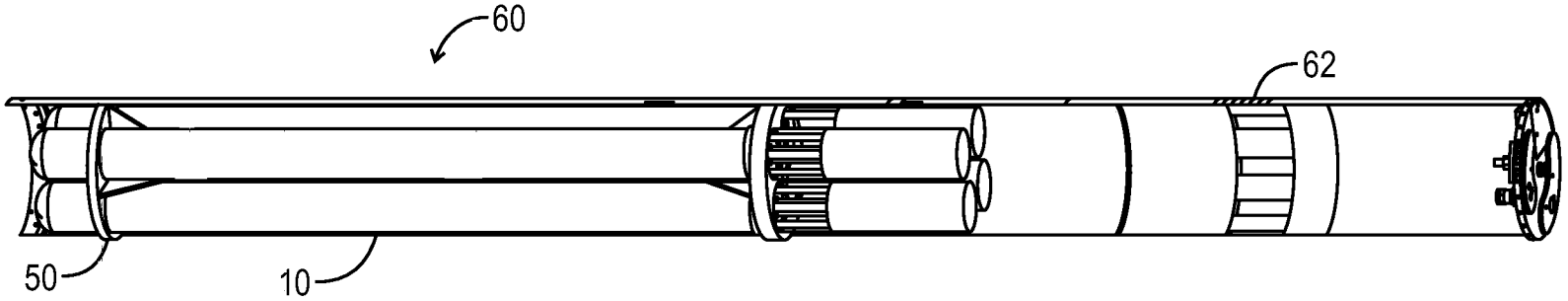
FIG. 5 depicts a cut-away isometric view of the small vehicle encapsulation capsule of the present invention with the capsule enclosing a module frame loaded with containment canisters.

In FIG. 5, a small vehicle encapsulation (SVE) capsule 60 of the present invention provides positioning of the containment canisters 10 on the module frame 50. The SVE capsule 60 includes circumferential flow slots 62 around a periphery of the capsule.

In operation, a signal is sent to one of the actuators 22 to retract the plug 30 aft of the flow ports 26. As the containment canister 10 is flooded by a water impulse thru the flow ports 26; the impulse contacts the aft end of the vehicle 100. The water impulse provides sufficient energy to launch the vehicle 100 out of the containment canister 10 and the SVE capsule 60.

The impulse launch is actuated by an air turbine pump (not shown) that generates water flow into the SVE capsule 60 and thru the flow ports 26. The ports 26 are sized to control the impulse. Air turbine pump launch systems can produce relatively high pressures and flow rates thru a launching system. Launch from the SVE capsule 60 would be similar to that of a torpedo tube in that an equalizing valve floods the capsule (tube) thus equalizing pressure with a sea environment. A muzzle door is opened in preparation for payload launch. The SVE capsule 60 can be an existing military-suitable capsule capable of encapsulating the containment canister 10, the module frame 50 and the actuator casing 20.

The present invention provides the benefits of modularity which include ease of design, manufacturing, and maintenance as well as the ease of loading and unloading vehicle and other items to be deployed.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A capsule for vehicle encapsulation, said capsule comprising:

a cylinder extending from a closed forward end to a closed aft end, said cylinder including a plurality of flow ports penetrating a periphery and proximate to the closed aft end of said cylinder;

a circular alignment plate interior to said cylinder with a first face of said plate parallel and proximate to the closed forward end of said cylinder, said alignment plate including a central aperture and four apertures between the central aperture and a perimeter of said alignment plate;

a hollow cylinder with a closed first end and a closed second end, said hollow cylinder in alignment with the central aperture and affixed at the first end to said alignment plate at a perimeter of the central aperture;

a canister foot plate affixed to the second end of said hollow cylinder, said foot plate including a central aperture aligned with the central aperture of said circular alignment plate, four apertures between the central aperture and the perimeter of said foot plate with the four apertures of said foot plate aligned with the four apertures of said alignment plate;

four containment canisters, each canister suitable for encapsulating the vehicle and in alignment with each of the four apertures of said forward circular alignment plate and with each of the four apertures of said foot plate with said canisters capable of movement thru the apertures, each of said containment canisters including a nose extending thru the forward end of said cylinder, a ring positioned aft of said nose at an interior circumference of each said canister with said ring conformable to an aft section of the vehicle and with each of said containment canisters including an open aft section;

four actuator casings, with each of said casings affixed to the open aft section of each of said containment canisters, and including plurality of flow ports penetrating a periphery of each of said actuator casings;

four linear actuators, each actuator positioned within each of said actuator casings aft of the flow ports of said actuator casings, each of said actuators including an arm with a plug extendable in a direction of said containment canisters; and four sealing rings, each ring positioned within each of said actuator casings aft of said containment canister and forward of said plug;

wherein each said actuator arm is capable of extending to seat said plug against said sealing ring;

wherein each said actuator arm is capable of retracting to move said plug aft of said flow ports of said actuator casing such that said containment canister is flooded by a water impulse thru the flow ports to expel the vehicle out of said containment canister and said capsule.

2. The capsule in accordance with claim 1 wherein each of said containment canisters further comprises at least three leads extending longitudinally along an interior of said canister such that the vehicle can be separated from the interior.

3. The capsule in accordance with claim 2 wherein said alignment plate further comprises at least four gussets with each of the gussets positioned between the apertures of said alignment plate and secured to an exterior of said hollow cylinder and a second face of said alignment plate.

4. The capsule in accordance with claim 3 wherein said canister foot plate comprises at least four gussets with each of the gussets positioned between the apertures of said canister foot plate and secured to an exterior of said hollow cylinder and a face of said canister foot plate.

5. A device for vehicle encapsulation, said device comprising:

a forward circular alignment plate including a central aperture and four apertures between the central aperture and a perimeter of said alignment plate;

a hollow cylinder with a closed first end and a closed second end, said hollow cylinder in alignment with the central aperture and affixed at the first end to said alignment plate at a perimeter of the central aperture;

a canister foot plate affixed to the second end of said hollow cylinder, said foot plate including a central aperture aligned with the central aperture of said forward circular alignment plate, four apertures between the central aperture and the perimeter of said foot plate with the four apertures of said foot plate aligned with the four apertures of said alignment plate;

four containment canisters, each suitable for encapsulating the vehicle and in alignment with each of the four apertures of said forward circular alignment plate and with each of the four apertures of said foot plate and with said canisters capable of movement within the apertures, each of said containment canisters including a nose, a ring positioned aft of said nose at an interior circumference of each said canister with said ring conformable to an aft section of the vehicle and with each of said canisters including an open aft section;

four actuator casings, with each of said casings affixed to the open aft section of each of said containment canisters, and including plurality of flow ports penetrating a periphery of each of said actuator casings;

four linear actuators, each actuator positioned within each of said actuator casings aft of the flow ports of said actuator casings, each of said actuators including an arm with a plug extendable in a direction of said containment canisters; and four sealing rings, each ring positioned aft of said containment canister and forward of said plug;

wherein each said actuator arm is capable of extending to seat said plug against said sealing ring;

wherein each said actuator arm is capable of retracting to move said plug aft of said flow ports of said actuator casing such that said containment canister is flooded by a water impulse thru the flow ports to expel the vehicle out of said containment canister.

6. The capsule in accordance with claim 5 wherein each of said containment canisters further comprises at least three leads extending longitudinally along an interior of said canister such that the vehicle is separated from the interior.

7. The capsule in accordance with claim 6 wherein said alignment plate further comprises at least four gussets with each of the gussets positioned between the apertures of said alignment plate and secured to an exterior of said hollow cylinder and a face of said alignment plate.

8. The capsule in accordance with claim 7 wherein said canister foot plate comprises at least four gussets with each of the gussets positioned between the apertures of said canister foot plate and secured to an exterior of said hollow cylinder and a face of said canister foot plate.

* * * * *